US006601922B2

(12) United States Patent
Doolan et al.

(10) Patent No.: US 6,601,922 B2
(45) Date of Patent: Aug. 5, 2003

(54) APPARATUS WITH LOWER LEG RESTRAINTS FOR CONTRIBUTING TO SUPPORT OF A HANDICAPPED PERSON

(76) Inventors: Alice Doolan, 3 Lydia Dr., West New York, NJ (US) 07093; Andrew J. Giehl, 75 Rollinson St., West Orange, NJ (US) 07052

( * ) Notice: Subject to any disclaimer, the term of this patent is extended or adjusted under 35 U.S.C. 154(b) by 0 days.

(21) Appl. No.: 09/919,648

(22) Filed: Aug. 1, 2001

(65) Prior Publication Data

US 2002/0017815 A1 Feb. 14, 2002

Related U.S. Application Data

(60) Provisional application No. 60/222,480, filed on Aug. 2, 2000.

(51) Int. Cl.[7] ..... A47C 31/00

(52) U.S. Cl. ..... 297/466; 297/423.11

(58) Field of Search ..... 297/464, 466, 297/463.1, 423.25, 423.5, DIG. 4, DIG. 10, 250.1, 256.15, 423.1, 423.11, 452.41; 5/81.1 RP; 601/24, 34, 35, 27–32

(56) References Cited

U.S. PATENT DOCUMENTS 485,277 A * 11/1892 Hunter
2,177,174 A * 10/1939 Eccles
2,789,624 A * 4/1957 Aucoin
3,179,360 A * 4/1965 Shelton et al.
4,145,083 A 3/1979 Urban
4,815,732 A * 3/1989 Mahvi ..... 297/467 X
4,906,047 A * 3/1990 Mikami ..... 297/466 X
4,930,842 A * 6/1990 Wilkinson et al. ..... 297/466
5,020,168 A 6/1991 Wood
5,040,522 A 8/1991 Daniels
5,690,389 A 11/1997 Ekman et al.
5,733,012 A 3/1998 Jones

* cited by examiner

*Primary Examiner*—Peter M. Cuomo
*Assistant Examiner*—Stephen Vu
(74) *Attorney, Agent, or Firm*—Gerald E. Hespos; Anthony J. Casella

(57) ABSTRACT

An apparatus is provided to enable a handicapped person to sit without restraints on the torso and arms. The apparatus includes a horizontal support wall with a pair of foot restraints adjustably mounted thereon. A leg restraint assembly is adjustably mounted to the horizontal support wall at a location between the foot restraints. The leg restraint assembly extends upwardly from the horizontal support wall and includes a pair of leg restraints dimensioned and disposed to releasably restrain lower portions of the leg. The horizontal support wall is configured to accommodate a seat, such as an inflatable ball.

9 Claims, 6 Drawing Sheets

APPARATUS WITH LOWER LEG RESTRAINTS FOR CONTRIBUTING TO SUPPORT OF A HANDICAPPED PERSON

This application claims priority on U.S. Provisional Patent Appl. No. 60/222,480, filed Aug. 2, 2000.

BACKGROUND OF THE INVENTION

1. Field of the Invention

The subject invention relates to an apparatus with lower leg restraints for contributing to the support of a handicapped person in a sitting position or in a standing position.

2. Description of the Related Art

Certain people have severe physical, neurological or mental handicaps that limit their motor control. For example, people with cerebral palsy (CP) have varying degrees of involuntary spasmatic movement of their limbs. This involuntary movement of the limbs may prevent a person with CP from sitting unrestrained in a chair. Falling from even a relatively low chair can be physically and emotionally traumatic. As a result, many people with CP are seated in wheelchairs with their legs, torsos and arms restrained. Prolonged sitting with the arms and torso restrained can be very uncomfortable, demeaning and unproductive.

Other people who may be unable to support themselves include stroke victims and people with mental disabilities.

Physical therapy can improve motor control for many handicapped people, including people with CP. Such physical therapy can be very intensive, and typically requires close one-on-one cooperation between a physical therapist and the person who requires the therapy. However, the physical restraints required for many handicapped people complicate the work of the physical therapist. Thus, the therapist may be limited to performing therapy on only one part of the body while other parts are physically restrained. Alternatively, the therapist may be preoccupied with ensuring the support of an unrestrained patient, thereby limiting the therapist's efforts to complete developmental exercises.

The prior art includes many devices that can be used as part of physical therapy, and other devices that can be used for seating. For example, prior art devices used for physical therapy include inflatable rubber balls marketed under the trademark PHYSIOBALL. These large balls are commercially available from 1–3 feet in diameter and are sufficiently strong to bear the weight of a human. The physical therapist may fashion various exercises that require the handicapped person to manipulate a ball or to support parts of their body on a ball.

Inflatable devices also have been incorporated into chairs. For example, U.S. Pat. No. 5,690,389 shows a chair with a rolling platform that has an adjustable cylinder projecting upwardly from the platform. A specially configured inflatable ball has a cylindrically configured recess extending radially into the ball. The recess is dimensioned to telescope over the cylinder. A rear support extends beyond the ball and is configured to engage the lower part of the back of a person seated on the ball. A pair of side supports project upwardly to engage the opposed sides of the pelvis. The modest support achieved by the chair shown in U.S. Pat. No. 5,690,389 would make that chair unsuitable for many handicapped people.

U.S. Pat. No. 5,733,012 is directed to a chair with a cushion supported on a frame. The horizontal surface of the frame includes a central opening, and a flexible compressible bag is registered with and projects slightly from the opening in the horizontal surface of the frame. The support enabled by the cushion and by the flexible compressible bag are intended to eliminate bed sores.

U.S. Pat. No. 4,145,083 is directed to a chair specifically intended for a child with CP. The chair includes inflatable bladders in the horizontal and vertical sections of the chair. Inflation of the bladders is controlled to provide an acceptable and desired amount of support for the child.

U.S. Pat. No. 5,020,168 is directed to an inflatable chair that is intended to be used to bathe a handicapped person. The chair includes straps to encircle and restrain both the hips and the chest and straps to engage around the ankles.

U.S. Pat. No. 5,040,522 is directed to a chair that can be used for physical therapy. The chair includes a first support for strapped engagement around the thigh of a patient, a second support that can be strapped to the calf or ankle area of a patient and a hinged connection between the two supports. The respective supports can be adjusted to position the hinged connection substantially on the axis of rotation defined by the knee. Thus, the device is intended to provide a controlled therapeutic movement of the lower leg about the hinged connection of the supports.

The prior art chairs do not provide sufficient support for a handicapped person while leaving the arms and torso free for physical therapy or other activities.

In view of the above, it is an object of the subject invention to provide a support for a handicapped person with substantially minimal constraint on the upper body.

It is another object of the subject invention to provide a seat for a handicapped person with sufficient support to prevent falling while substantially avoiding restraints on the hips, torso and arms.

SUMMARY OF THE INVENTION

The subject invention is directed to a support apparatus that is intended for use by a handicapped person. The apparatus includes: a pair of foot restraints for releasably holding the feet of the handicapped person; a pair of lower leg restraints for releasably holding portions of the legs below the knee; and means for accommodating a seat. The seat may be an inflatable seat, such as an inflatable ball. Alternatively, the seat can take other forms, and may be a toilet. The foot and leg restraints may be releasably and/or adjustably secured to a base that has an opening for accommodating the seat. Thus, the apparatus enables the foot and lower leg restraints to be positioned adjustably relative to the seat.

The apparatus enables the handicapped person to be seated comfortably with foot and lower leg restraints and without torso and arm restraints. The foot and lower leg restraints provide adequate support for many situations and enable the handicapped person to focus on balancing the upper torso and performing functions with the arms and/or head. The absence of torso and arm restraints provides much greater comfort for the handicapped person, particularly during warm weather. Furthermore, the absence of arm and torso restraints enables a physical therapist to work more efficiently on exercises intended to develop strength and coordination of upper body muscles. Still further, the absence of arm and torso restraints enables the handicapped person to assume upper body positions other than the purely erect position required when restrained in a wheelchair. This latter option is particularly useful when the apparatus is used in combination with a toilet, in that the handicapped person can assume an upper body position more conducive to the bodily function being carried out.

DETAILED DESCRIPTION OF THE PREFERRED EMBODIMENT

Figure 1:
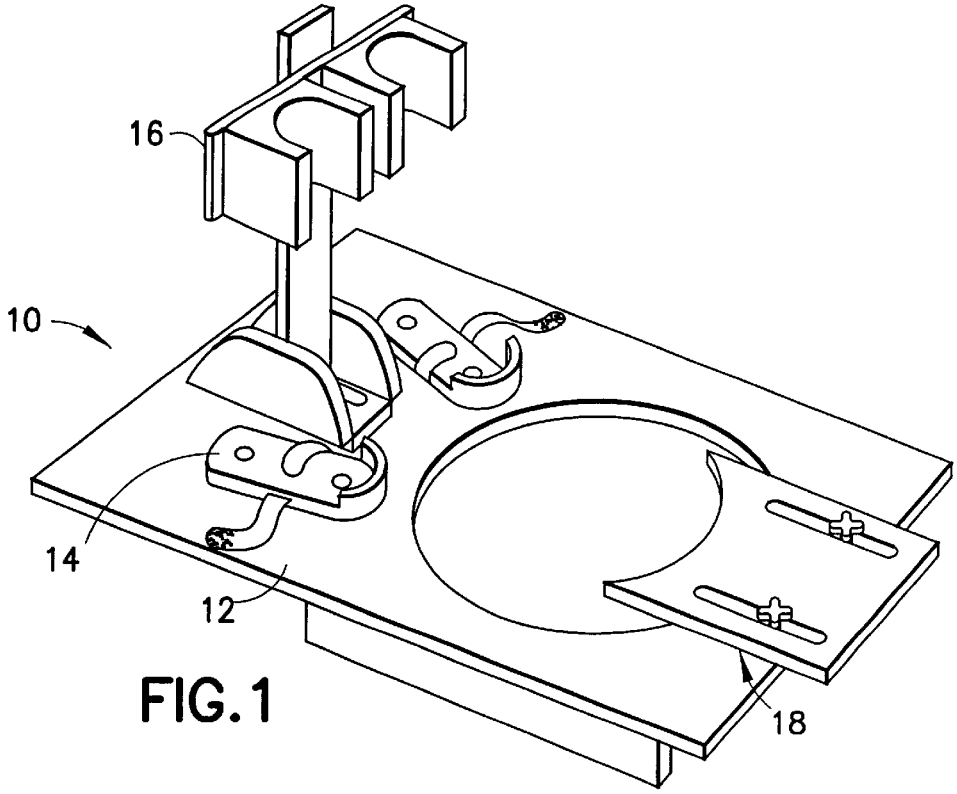
FIG. 1 is a perspective view of the apparatus of the subject invention.

The apparatus of the subject invention is identified generally by the numeral 10 in FIG. 1. The apparatus 10 includes a base 12, foot restraints 14, a leg restraint assembly 16 and a seat restraint 18.

Figure 2:
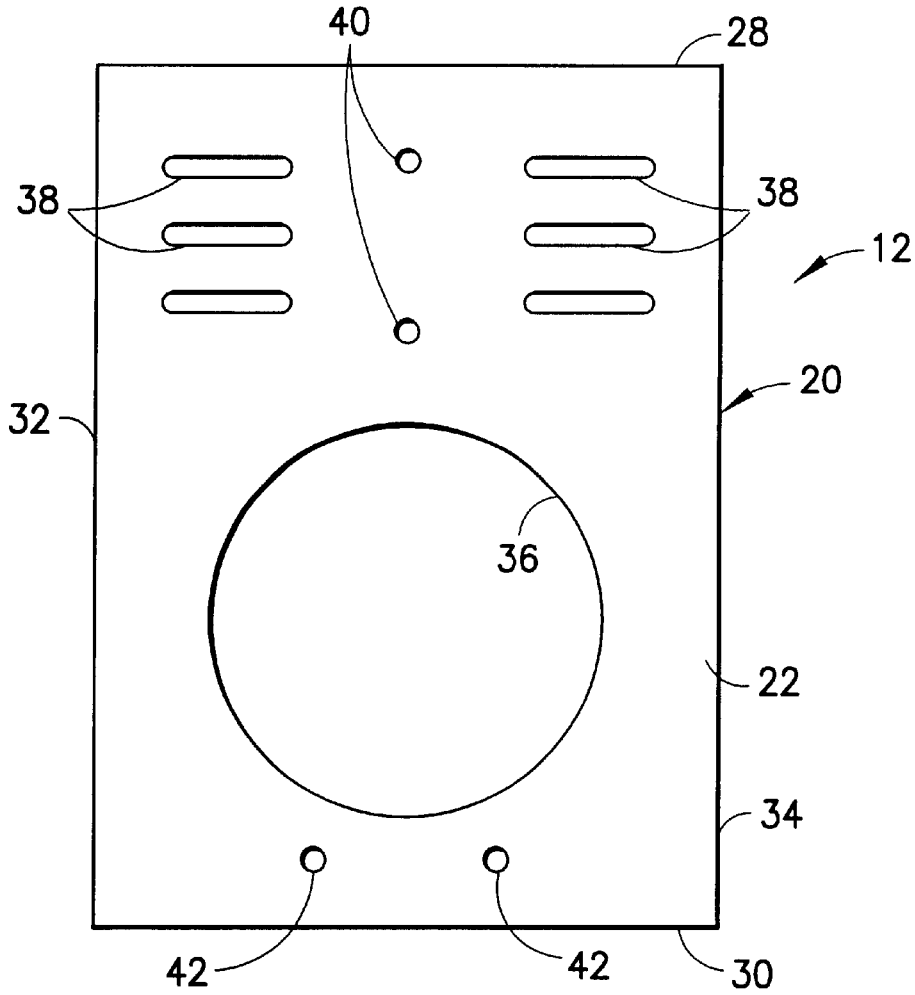
FIG. 2 is a top plan view of the base of the apparatus.
Figure 3:
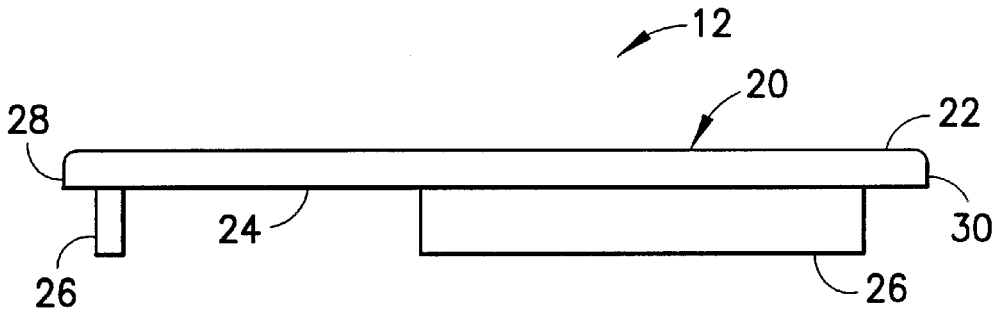
FIG. 3 is a side elevational view of the base.

The base 12, as shown most clearly in FIGS. 2 and 3, comprises a substantially planar horizontal support wall 20 having opposed upper and lower surfaces 22 and 24. Support legs 26 extend downwardly from at least peripheral regions of the lower surface 24 to enable the horizontal support wall 20 to be supported in spaced relationship to a floor.

The horizontal support wall 20 includes opposed front and rear edges 28 and 30 respectively and opposed left and right side edges 32 and 34 respectively. A seat support opening 36 extends through the horizontal support wall 20 at a location substantially centrally between the side edges 32 and 34 and at a location closer to the rear edge 30 than to the front edge 28. In the illustrated embodiment, the seat support opening 36 is substantially circular and is spaced forwardly of the rear edge 30 of the horizontal support wall 20. In other embodiments, however, the seat support opening may extend to the rear edge 30 so that the entire horizontal support wall 20 can be slid rearwardly into partly surrounding relationship around the base of a toilet.

The horizontal support wall 20 includes a plurality of additional openings extending entirely therethrough to enable adjustable mounting of the other parts of the apparatus, as explained further herein. In particular, a plurality of slots 38 extend through the horizontal support wall 20 at locations between the front edge 28 and the seat support opening 36. Each slot 38 is substantially parallel to the front and rear edges 28 and 30. Additionally, a first plurality of the slots 38 are disposed closer to the left side edge 32, while a second plurality of the slots 38 are closer to the right side edge 34. Each slot 38 in the left plurality is collinear with a corresponding slot in the right plurality. As explained further below, the slots 38 enable adjustable mounting of the foot restraints 14.

The horizontal support wall 20 further includes a pair of leg restraint mounting apertures 40 that extend through a horizontal support wall 20 from the top surface 22 to the bottom surface 24 thereof. The leg restraint mounting apertures 40 are substantially centrally disposed between the left and right side edges 32 and 34 of the horizontal support wall 20. Additionally, the leg restraint mounting apertures 40 are at a location between the front edge 28 of the horizontal support wall 20 and the seat mounting opening 36.

A plurality of seat restraint mounting apertures 42 extend through the horizontal support wall 20 from the top surface 22 to the bottom surface 24 at a location between the rear edge 30 and the seat mounting opening 36. The seat restraint mounting apertures 42 are spaced equally from the rear edge 30 and are spaced symmetrically inwardly from the respective left and right side edges 32 and 34.

The foot restraints 14 may be similar to foot restraints employed on a snowboard. For example, the foot restraints 14 include a planar sole support 44 having a pair of openings 46 extending therethrough. Flat-head mounting bolts can be extended through the openings 46 and through selected slots 38 in the horizontal support wall 20 of the base 12 to secure the foot restraints 14 to the base 12. The particular slots 38 in which the bolts are mounted determine the relative proximity of the foot restraints 14 to the front edge 28 of the horizontal support wall 20. Within any pair of slots 38, each foot restraint 14 can be moved laterally toward or away from the respective side edge 32 or 34. These relative positions can be adjusted in accordance with the size of the person who will use the apparatus 10.

Each foot restraint 14 further includes a heel support 50 projecting upwardly from a rear portion of the respective foot restraint. Additionally, each foot restraint 14 includes a Velcro strap 52. The Velcro strap 52 extends beneath or through the foot restraint 14, and opposed ends of the strap 52 can be secured to one another to restrain a foot releasably in the foot restraint 14.

Figure 4:
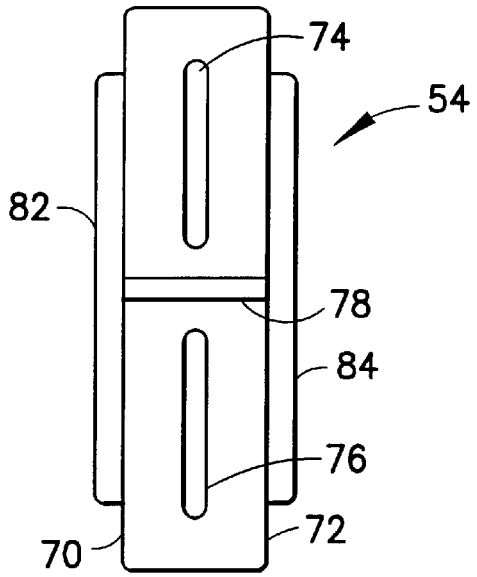
FIG. 4 is a top plan view of the vertical support for the leg restraint subassembly.
Figure 5:
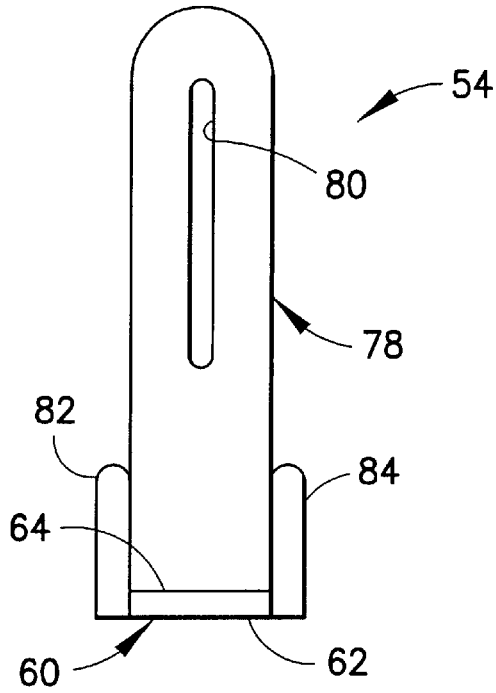
FIG. 5 is a front elevational view of the vertical support of the leg restraint subassembly.
Figure 6:
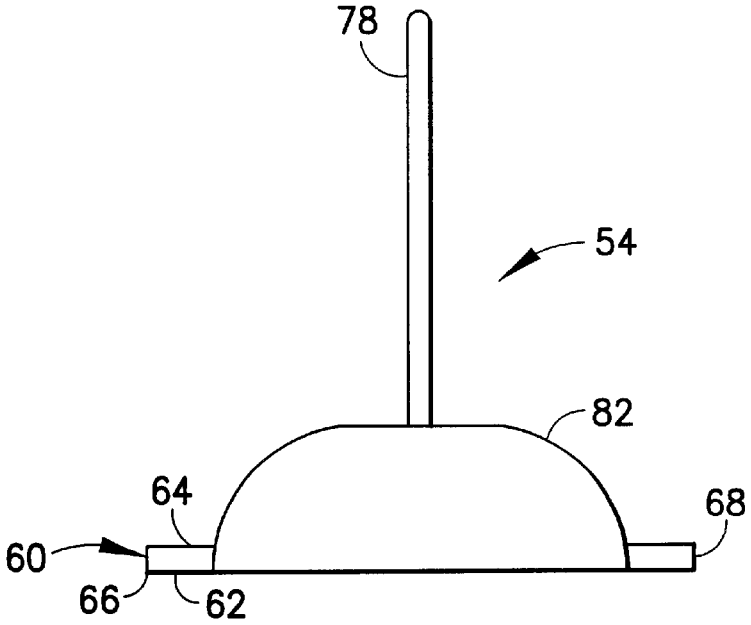
FIG. 6 is a side elevational view of the vertical support for the leg restraint subassembly.

The leg restraint assembly 16 includes a vertical support 54, a horizontal support 56 and a pair of leg restraints 58. The vertical support 54 as shown in FIGS. 4–6 includes a horizontal base wall 60 with a planar bottom surface 62 and a planar top surface 64. The base wall 60 further includes a front edge 66, a rear edge 68 and side edges 70 and 72. Front and rear mounting slots 74 and 76 extend through the base wall 60 at locations centrally between the side edges 70 and 72. The front mounting slot 74 is closer to the front edge 66, and the rear mounting slot 76 is closer to the rear edge 68.

A vertical wall 78 extends upwardly from the base wall 60 at a location between the front and rear mounting slots 74 and 76. The vertical wall 78 includes a vertical mounting slot 80 at a location centrally between the side edges of the vertical wall 78 and at a location spaced upwardly above the base wall 60.

The vertical support 54 of the leg restraint subassembly 16 further includes a pair of side walls 82 and 84 which extend upwardly from the side edges 70 and 72 of the base wall 60 and which are secured to the respective sides of the vertical wall 78. The side walls 82 and 84 provide required structural support for maintaining perpendicularity between the vertical wall 78 and the base wall 60.

Figure 7:
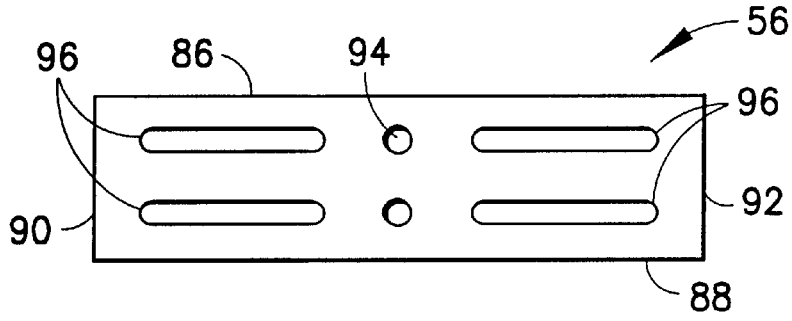
FIG. 7 is a front elevational view of the horizontal support for the leg restraint subassembly.
Figure 8:
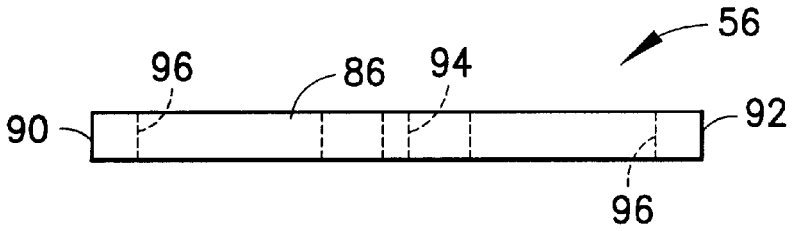
FIG. 8 is a top plan view of the horizontal support.

The horizontal support 56 of the leg restraint assembly 16 is shown in FIGS. 7 and 8, and is an elongate substantially planar member having a top edge 86, a bottom edge 88 and opposed left and right side edges 90 and 92. Apertures 94 extend through the horizontal support 56 at a location centrally between the left and right side edges 90 and 92, as shown most clearly in FIG. 7. Additionally, horizontal slots 96 extend through the horizontal support 56 and are aligned substantially parallel to the top and bottom edges 86 and 88. The horizontal slots 96 include a first plurality located between the apertures 94 and the left edge 90 of the horizontal support 86 and a second plurality between the apertures 94 and the right edge 92. Each horizontal slot 96 in the left plurality is aligned with a corresponding horizontal slot 96 in the right plurality.

Figure 9:
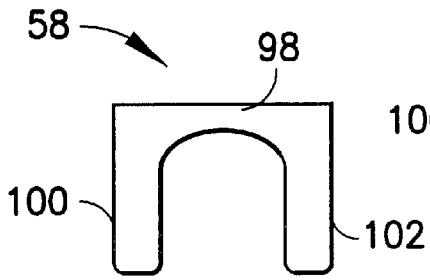
FIG. 9 is a top plan view of a leg restraint for the leg restraint subassembly.
Figure 10:
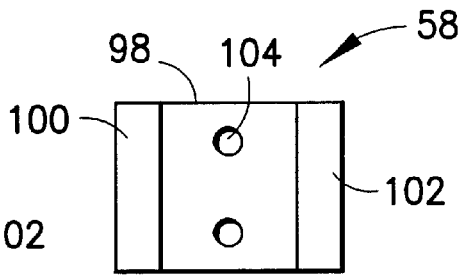
FIG. 10 is a rear elevational view of the leg restraint.
Figure 12:
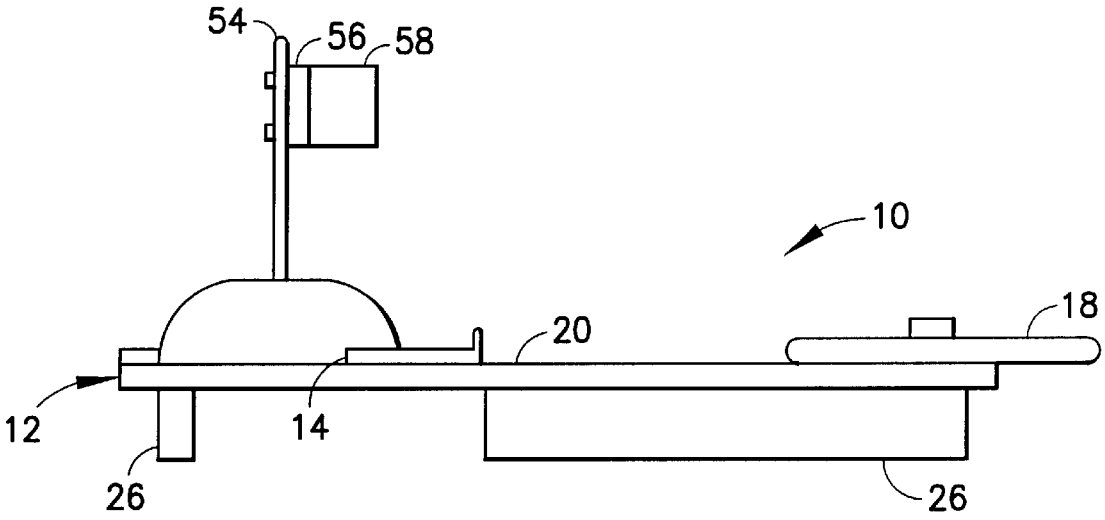
FIG. 12 is a side elevational view of the apparatus shown in FIGS. 1 and 11.
Figure 13:
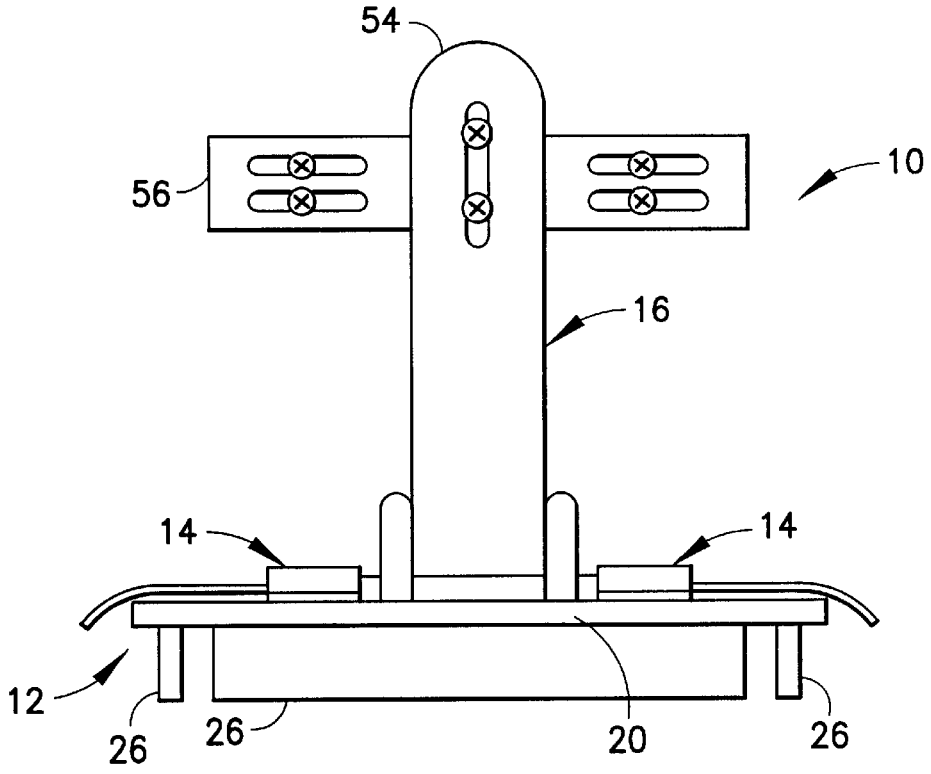
FIG. 13 is a front elevational view of the apparatus shown in FIGS. 1, 11 and 12.

The leg restraints 58 are short substantially U-shaped channels as shown in FIGS. 9 and 10. More particularly, each leg restraint 58 includes a planar front wall 98 and a pair of spaced apart side walls 100 and 102 projecting from the front wall 98. The front wall 98 includes a plurality of mounting apertures 104 spaced from one another by distances substantially equal to the spacing between the horizontal mounting slots 96 in the horizontal support 56. Thus, flat-head bolts can be extended through the mounting apertures 104 of the leg restraints 58 to securely and adjustably position the leg restraints 58 on the horizontal support 56, as explained further below. The distance of projection of the side walls 100 and 102 from the front wall 98 and the spacing between the side walls 100 and 102 is selected to securely but releasably retain a portion of a person's leg slightly below the knee. These leg dimensions will vary from person to person. Hence, the leg restraint 58 will be selected for a particular user of the apparatus 10. The leg restraints 58 are formed from a material that exhibits some resiliency, but adequate strength to retain the leg therein. Various foams or rubber have proved to be acceptable. Additionally, restraint straps can be provided on the leg restraints 58 for releasably holding the legs in the respective leg restraints 58.

Figure 11:
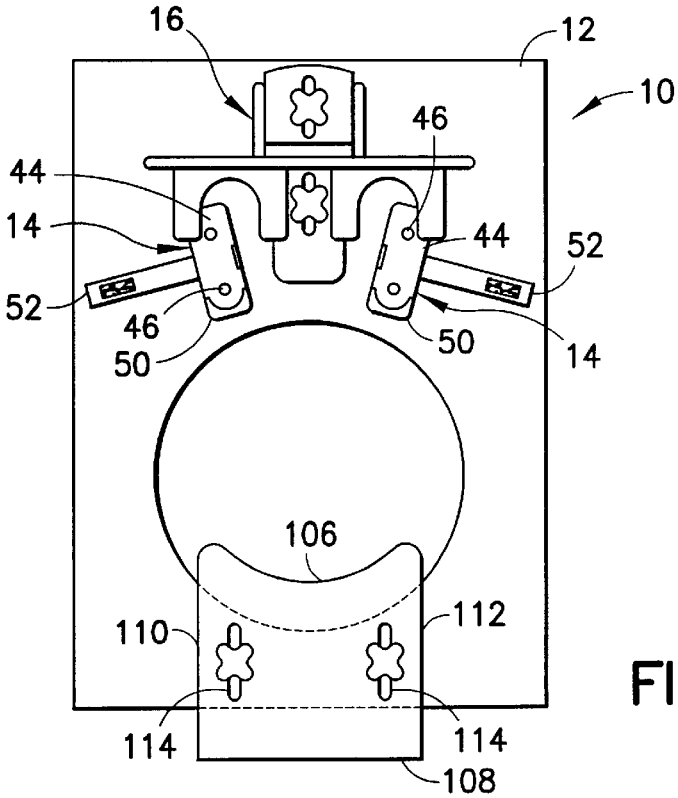
FIG. 11 is a top plan view of the assembled apparatus shown in FIG. 1.

The seat restraint 18 as shown in FIG. 11 is a substantially planar member having a concave arcuate front edge 106, a rear edge 108 and a pair of side edges 110 and 112. A pair of longitudinal slots 114 extend substantially parallel to the side edges 110 and 112. The spacing between the slots 114 substantially corresponds to the spacing between the seat restraint mounting apertures 42 in the horizontal support wall 20 of the base 10.

The assembled apparatus 10 of the subject invention is shown in FIGS. 1 and 11–14. More particularly, the apparatus 10 is assembled by mounting the foot restraints 14 to the top surface 22 of the horizontal support wall 20 of the base 12. More particularly, flat head bolts are passed through the respective foot restraints 14 and through selected slots 38 in the horizontal support wall 20. The particular slots 38 are selected in accordance with the size of the person to be using the apparatus 10. Forward and reward positioning of the foot restraints 14 is determined by the particular slots 38 that are selected for receiving the bolts that pass through the foot restraints 14. Side-to-side positioning of the foot restraints 14 can be achieved merely by sliding the bolts in the selected slots 38. Additionally, some angular alignment changes of the foot restraints 14 is permitted by rotating the foot restraints 14 about one of the bolts.

The assembly proceeds by mounting the seat restraint 18 to the top surface 22 of the horizontal support wall 20. More particularly, bolts are passed upwardly through the apertures 42 in the horizontal support wall 20, and through the slots 114 in the seat restraint 18. Nuts then are mounted to the bolts and are tightened slightly. The seat restraint 18 then can be slid along the top surface 22 such that the concave arcuate front edge 106 is at a selected position overlying the circular seat mounting opening 36 in the horizontal support wall 20. The particular location of the concave front edge 106 in the circular opening 36 will be selected in view of the size of an inflatable ball or other such seat to be placed in the opening 36. This size, in turn, will be determined by the size of the person using the apparatus or by the type of therapy to be performed by the therapist.

The leg restraint assembly 16 is assembled by securely mounting the horizontal support 56 to the vertical wall 78 of the vertical support 54. More particularly, the apertures 94 of the horizontal support 56 are aligned with the vertical slot 80 of the vertical support wall 78 and a pair of bolts are passed through the aligned apertures and slots and are tightened slightly. The horizontal support 56 then is slid to a selected position along the vertical support wall 78 and the bolts are further tightened. A pair of the leg restraints 58 then are mounted to the horizontal support 56. More particularly, bolts are passed through the apertures 104 in the front wall 98 of each restraint 58, and then are passed through the horizontal slots 96 in the horizontal support 56. The restraints 58 are slid horizontally along the horizontal support 56 and the bolts are tightened at a selected position thereon.

The leg restraint assembly 16 then is mounted to the top surface 22 of the horizontal support wall 20 of the base 12. More particularly, bolts are passed upwardly through the apertures 40 in the horizontal support wall 20 and through the slots 74 in the base wall 60. Nuts then are tightened slightly onto the bolts. The horizontal support assembly 16 then can be slid in a forward to rearward direction to achieve a selected location depending upon the size of the person using the apparatus 10. The nuts then can be tightened to securely hold the leg restraint assembly in a selected position.

Figure 14:
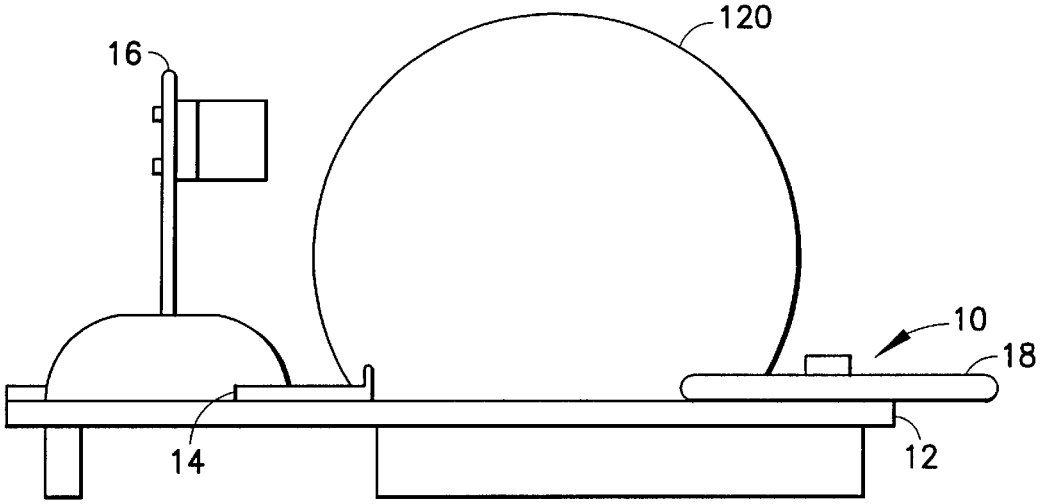
FIG. 14 is a side elevational view similar to FIG. 12, but showing an inflatable ball positioned in the base.

The apparatus 10 is used with or further comprises an inflatable ball 120, as shown in FIG. 14. The ball 120 is positioned in the seat support opening 36 in the horizontal support wall 20 of the base 12. An outer surface region of the ball 120 will be supported on a portion of the floor between the legs 26 of the base 12. The elevation of the top surface 22 of the horizontal support wall 20 will prevent the ball 120 from rolling beyond the base 12. The ball 120 may be rolled toward the front edge of the circular opening 36, and the seat retainer 18 may be slid forwardly to engage the ball 120. The seat retainer 18 then can be tightened into this position for preventing forward to rearward rolling of the ball 120.

The apparatus 10 is used by assisting a handicapped person into a position where the person's feet can be secured in the foot restraints 14 and where the lower portions of the person's legs can be loosely retained in the U-shaped leg restraints 58. The person then can sit on the inflatable ball 120. The foot and leg restraints 14 and 58 enable the handicapped person to be supported stably on the ball 120. More particularly, the resiliency of the ball will cause the ball 120 to deform slightly in response to the weight of the person seated on the ball 120. This creates a minor concavity of the top of the ball 120, which, in combination with the foot and leg restraints 14 and 16 support the handicapped person with considerable stability. This restraint arrangement enables the person's arms and torso to be free of restraint, and thereby enables the person to be comfortable and to perform various motor functions. Furthermore, the apparatus greatly increases the types of rehabilitation or developmental exercises that can be carried out with the assistance of a physical therapist.

While the invention has been described with respect to a preferred embodiment, it is apparent that various changes can be made without departing from the scope of the invention as defined by the appended claims. For example, the seat can take forms other than the ball depicted in FIG. 14. Thus, a generally rectangular or cylindrical inflatable seat can be positioned in a correspondingly configured opening in the base. In other embodiments, the rear end of the base can define a U-shape to enable the base to be nested around the front of the base of a toilet. The handicapped person then can be seated in a comfortable position on the toilet with only the feet and lower legs restrained. Still further, several of the parts have been shown as being adjustable. Adjustability is a convenient feature where the apparatus will be used by a physical therapist who will have to accommodate people of different sizes. However, the apparatus can be dedicated to a particular person. In this instance, adjustability is not critical. Finally, the shapes of the respective parts are intended only to be illustrative. Other shapes for achieving a similar function also may be provided. For example, the leg restraints could be provided with a Velcro-type of attachment on the U-shaped restraint. Alternatively, the U-shaped structure could be replaced entirely with a broad comfortable strap. Finally, some handicapped patients are able to stand. The apparatus can enable such standing by supporting the feet and lower leg as explained above.

What is claimed is:

1. A seating apparatus for a handicapped person, said apparatus comprising a horizontal support wall having upper and lower surfaces, a plurality of support legs legs projecting downwardly from the lower surface for maintaining the horizontal support wall above a supporting surface, a pair of foot restraints secured to the upper surface of the horizontal support wall, a leg restraint assembly mounted to the upper surface of the horizontal support wall and including a pair of restraints configured for restraining lower portions of the legs of the handicapped person, wherein the horizontal support wall further comprises a substantially circular opening, and an inflatable ball secured in the circular opening and defining a seat to enable the handicapped person to sit with feet and lower of portions of the legs releasably restrained by the foot restraints and the leg restraints.

2. The apparatus of claim 1, wherein the foot restraints are adjustably mounted on the horizontal support wall.

3. The apparatus of claim 1, wherein the leg restraint assembly comprises a base wall mounted to the upper surface of the horizontal support wall at a location substantially between the foot restraints, a vertical wall extending upwardly from the base wall and a horizontal support wall extending transversely from the vertical wall, a pair of leg restraints mounted to the horizontal support wall at locations on opposite respective sides of the vertical wall.

4. The apparatus of claim 3 wherein the leg restraints comprise substantially U-shaped channels dimensioned and configured for releasably holding the legs of the handicapped person.

5. The apparatus of claim 4, wherein the leg restraints are formed from foam.

6. The apparatus of claim 4, wherein the leg restraints are adjustably mounted on the horizontal support.

7. The apparatus of claim 6, wherein the horizontal support is adjustably mounted on the vertical support.

8. The apparatus of claim 7, wherein the base wall of the leg restraint assembly is adjustably mounted on the horizontal support wall of the base.

9. The apparatus of claim 1, further comprising a ball restraint adjustably mounted to the horizontal support wall in proximity to the circular opening, the ball restraint being movable into and out of the circular opening for effectively altering dimensions of the circular opening.

* * * * *